United States Patent [19]

Schnippering et al.

[11] Patent Number: 4,715,895

[45] Date of Patent: Dec. 29, 1987

[54] METHOD OF PRODUCING MOLDS FOR THE CASTING OF METAL

[75] Inventors: Friedhelm Schnippering, Siegburg; Karl-Martin Rödder, Troisdorf-Spich, both of Fed. Rep. of Germany

[73] Assignee: Dynamit Nobel AG, Troisdorf Bez Koeln, Fed. Rep. of Germany

[21] Appl. No.: 908,879

[22] Filed: Sep. 15, 1986

Related U.S. Application Data

[63] Continuation-in-part of Ser. No. 768,914, Sep. 15, 1984, abandoned, which is a continuation of Ser. No. 593,176, Mar. 26, 1984, abandoned, which is a continuation of Ser. No. 430,093, Sep. 30, 1982, abandoned.

[30] Foreign Application Priority Data

Oct. 30, 1981 [DE] Fed. Rep. of Germany ..... 3143036

[51] Int. Cl.[4] ..... B28B 7/28

[52] U.S. Cl. ..... 106/38.3; 106/38.35

[58] Field of Search ..... 106/38.3, 38.35

[56] References Cited

U.S. PATENT DOCUMENTS

| | | | |
|---|---|---|---|
| 2,851,752 | 9/1958 | Benham | 106/38.35 |
| 3,232,771 | 2/1966 | Pearce | 106/38.35 |
| 3,428,465 | 2/1969 | McLeod | 106/38.35 |
| 3,432,312 | 3/1969 | Feagin | 106/38.3 |
| 4,059,453 | 11/1977 | Dittrich | 106/38.3 |

*Primary Examiner*—Theodore Morris

*Attorney, Agent, or Firm*—Felfe & Lynch

[57] ABSTRACT

The present invention relates to the production of molds for the casting of metal. The molds are made of refractory materials bound together by a binding agent on the basis of a partially hydrolyzed, partially condensed silicic acid ester. A slip consisting of binding agent and refractory material is applied to the model alternately with a granular refractory sanding material. In accordance with the invention, the granular refractory sanding material contains the agent for hardening the binding agent. The method of the invention makes possible the dimensionally accurate reproduction of even relatively large models, while the slip can be stored over a relatively long period of time without loss of its action.

10 Claims, No Drawings

METHOD OF PRODUCING MOLDS FOR THE CASTING OF METAL

This application is a continuation in part of Ser. No. 768,914 filed Sept. 15, 1984 which is a continuation of application of Ser. No. 593,176, filed on Mar. 26, 1984 which is a continuation of the application Ser. No. 430,093 filed on Sept. 30, 1982 all abandoned therewith.

This invention relates to the production of metal-casting molds with binding agents based on silicic acid esters and refractory substances. The binding agents and refractory materials form a fluid slip which is applied to the model and then sanded. Hardening is effected by means of a hardening agent contained in the sanding material.

In U.S. Pat. No. 4,059,453 a method is described for the production of metal-casting molds, in which one or more coats of a fluid slip is sprayed onto permanent models and backed with a layer of fireclay before the slip is hardened. In this method the slip contains the hardener in addition to solvent and anti-settling agents, so that the slip can harden within a short period of time, before it can drain off from a steep wall surface of the model, for example.

The above-described procedure is especially suitable for producing castings of large dimensions, the surface structure of the model being reproduced in a precise and dimensionally accurate manner. The method, however, has the disadvantage that, in the series production of molds, the slip becomes increasingly solidified in the tool and in the course of time clogs up the output tubes of orifices. This clogging is due to the fact that the slip contains the hardener. The solution, of not mixing the hardener with the slip, but hardening it after application, does not produce the desired outcome: either the slip runs down too rapidly on the vertically disposed outside walls of the model before it hardens, or else the simultaneous application of a hardening gas, such as ammonia, results in a pollution of the environment which is difficult to avoid.

The problem therefore existed of devising a method for the production of metal-casting molds, especially for the production of castings of large dimensions, in which one or two layers of a fluid ceramic mass composed of refractory substances and a binding agent based on a hydrolyzed silicic acid ester are applied to permanent models by means of an appropriate tool, and are then sanded and hardened while largely avoiding the above-mentioned disadvantages.

BRIEF SUMMARY OF THE INVENTION

To solve this problem, such a method has now been found, and it is characterized by the fact that the sanding substance contains the hardener. The binder used and the slip used contain no free water. The binder in the slip cures without the addition of water.

By means of the method of the invention, it is possible to produce metal-casting molds even from relatively large models without having the binding agent harden prematurely in the tools used for applying the binding agent and/or clog their tubes or orifices. It is thus possible to store for a relativly long period of time the materials used in preparing the molds, or to let already-mixed starting materials stand for a long time without hardening.

The application of the fluid ceramic mass—referred to hereinafter also as "slip"—to the model is performed in a manner known in itself tools known in the spraying art. The mass emerges generally under pressure from a nozzle or from a corresponding orifice. By moving the tool back and forth over the surface of the model, the mass is uniformly applied thereto and then directly sanded.

The sanding is performed with a granular refractory substance, such as calcined kaolin or mullite. The grain size of the sanding material is preferably between 0.12 and 0.25 mm. However, grains ranging between 0.07 and 1 millimeter can be used, which are preferably applied such that the grain sizes increase from the inside out. A highly preferred grain size range is 0.07 to 0.25 mm.

The sanding material is mixed with the hardner in a preceeding procedure. The amount of hardener contained in the sanding material depends largely on the nature of the hardener. In general, amines are used as hardeners which are liquid at room temperature and of which approximately up to 2% by weight can be uniformly mixed with the sanding material without separation. If desired, a finely granular, highly absorbent material can be added to the sanding material, such as finely divided silica, e.g. Aerosil ®; thus the free-flowing quality of the sanding material is preserved. The slip layer can be sanded by the spin-on deposition method.

The sanding material is thrown onto the slip coating, if possible, with the aid of tools which are known from the spraying and dusting art. The dimensions of the nozzles and tubes in these tools must, of course, be adapted to the grain sizes of the sanding material.

The sanding is performed directly after the slip is sprayed on, so that the individual grains of the sanding material can penetrate into the slip coating and be held fast by the latter. The amount of sanding material to be applied depends the thickness of the slip previously applied, which insofar as possible should be of the order of 0.5 to 2.0 millimeters. Sanding material is applied until it will no longer adhere to the slip coat. After the sanding has been completed, the process of applying the slip and then sanding in the manner described can be repeated one or more times depending on the total thickness whcih the finished mold is to have. The total thickness is generally 4 to 8 mm, although it can also be thicker.

The slip contains as binding agent a partially condensed alkyl silicate containing hydroxyl groups. Such alkyl silicates are known; they are prepared by the partial hydrolysis of partially condensed alkyl silicates which have a silica content between 35 and 51% and contain up to 10 SiO groupings. In the partial hydrolysis, which is known in itself and is not subject matter of the present invention, compounds form which have an $SiO_2$ content between 8 and 35%, preferably between 18 and 25% by weight. These hydrolyzates contain randomly distributed ester and hydroxyl groups.

The alkyl moieties of the above-named alkyl silicates have preferably 1 to 8 carbon atoms.

The alkyl silicates containing the partially condensed hydroxyl groups can be replaced in part by partially condensed alcoholates of aluminum, zirconium or titanium or by mixtures of these compounds Suitable compounds of this class are named, for example, in German Patent No. 2,204,531. Mixtures of these alcoholates with the above-mentioned partially condensed alkyl silicates can also be used.

In addition to the binding agent the slip can also contain an inert organic solvent in which the binding agent is soluble. It is thus possible to keep the slip coating moist for a longer time, so that in this manner the time available for the subsequent sanding can be longer. Especially suitable solvents are higher-boiling alcohols having boiling points above 120° C., such as for example the alkyl ethers of ethylene glycol The solvents are used in amounts between 5 and 50%, preferably between 20 and 30%, of the weight of the binding agent.

The refractory substances which the slip contains are preferably refractory oxides or silicates, such as the electric furnace products based on aluminum oxide, silicon dioxide, zirconium oxide or mullite, or minerals such as zirconium silicate, sillimanite, chromium-containing sands or quartz sand, or similar substances, either alone or in mixtures.

The slip contains these refractory substances in amounts between 50 and 95%, preferably between 70 and 90%, by weight. The grain size of these substances can amount to as much as 0.12 mm; in general, however, grain sizes up to 0.07 mm are used, while the preferred range is between 0 and 0.04 mm.

The slip can furthermore contain an anti-settling agent if it appears necessary on the basis of the composition, grain size and material used, so as to prevent separation of the binding agent and refractory substance. Substance are used as anti-setting agents which are known from the paint art as thixotropic or thickening agents. Preferred are substances on the basis of montmorillonite along with an organic solvent, for example, such as a glycol and ethanol mixture, expanded bentonites or organic montmorillonite derivatives, pyrogenic silicic acid, cellulose esters such as ethyl cellulose, or cellulose ethers resinous products on the basis of hydrogenated castor oil, talc, mica, or mixtures of these, or other substances of similar structure.

The amount of antisettling agent to be added will vary widely depending on the density and on the nature and quantity of the refractory substance and of the binding agent. The quantity ratio of liquid binding agent to dry refractory substance to antisettling agent is best adjusted such that the ceramic mass will on the one hand have a sprayable consistency, but on the other hand will adhere even to steep walls on models and not run down thereon. Examples of suitable mixtures in which the ratio of the binding agent and antisettling agent to the highly refractory substance amounts to from 1:1 to 1:3, depending on the refractory substance and the spray apparatus.

Deviations from these quantity ratios are possible, since the optimum flow characteristics and binding properties of the ceramic mass used in accordance with the invention depend not only on the nature and amount of the binding agent and of the antisettling agents, but also on the specific surface area of the highly refractory grains.

After the refractory mass has been sanded, the mass sets by chemical action. This hardening is based on a shift of the pH of the binder into the range in which rapid formation of gels takes place. Generally this range is close to the neutral point. Since the binder mixtures are usually acid, any substance which consumes the acid acts as a hardener.

For this reason, in addition to all basically reacting substances, substances can also be used as hardeners whose transformation products with acids are less acid than the starting mixture. These include, for example, the salts of carbonic acid, such as calcium carbonate, and metals reacting with acids, such as zinc.

The chemical hardening agents are preferably the amines known as hardening agents, and they are mixed with the sanding material. Suitable amines in this case are not only primary but also secondary or tertiary amines. All that is essential to their hardening properties is that they or their solutions consume acid (shift the pH toward neutrality). As stated above, other basically reacting, organic or inorganic compounds can be used as hardeners, such as for example the salts or hydroxides of the alkali or alkaline earth metals or of ammonia. They can be mixed, if desired, in solid form with the sanding material.

DESCRIPTION OF PREFERRED EMBODIMENTS

The following examples will serve to explain the method of the invention.

A number of different spray slips and sanding mixtures were prepared for the following examples.

Spray slip A 139 g of an alcoholic solution of a partially hydrolyzed ethyl silicate 40 having an $SiO_2$ content of approximately 20% was mixed with 11 g of a paste on the following basis: 10 weight-parts of dimethyl-dioctadecyl-ammonium montmorillonite, 80 weight-parts of benzine, 10 weight-percent of an electroneutral wetting agent, emulsifying agent or dispersant on the basis of a salt of long-chain polyaminamides and an acid ester of high molecular weight, commercially obtainable under the name Anti-Terra-U. 225 g of a mullite of a grain size range from 0.00 to 0.04 mm was mixed into the solution thus obtained. The slip then had a viscosity of 21 sec of pouring time from a DIN 4 beaker.

Spray slip B

Preparation was similar to the preparation of spray slip A except that 200 g of a calcined aluminosilicate (commercial product Molochite® 100) was used instead of the mullite. Viscosity: 21 sec from DIN 4 beaker.

Spray slip C

Preparation was similar to the preperation of spray slip A except that 380 g of a DIN 100 zirconium silicate was used instead of the mullite. Viscosity: 19 sec from DIN 4 beaker.

| Sanding mixtures: | | |
|---|---|---|
| 1. | 1 | kg mullite, grain size 0.12 to 0.25 mm, |
| | 5.0 | g monoethanolamine, |
| | 5.0 | g Aerosil R 972 a highly dispersed silicic acid (commercial product of Degussa, Frankfurt on the Main). |
| 2. | 1 | kg mullite, grain size 0.12 to 0.25 mm, |
| | 5.0 | g diethanolamine, |
| | 5.0 | g Aerosil R 972 (Degussa) |
| 3. | 1 | kg mullite, grain size 0.12 to 0.25 mm, |
| | 10.0 | g mixture of monoethanolamine and water in a ratio of 1:1 by volume, |
| | 10.0 | g Aerosil R 972 (Degussa). |
| 4. | 600.0 | g calcined aluminosilicate (Molochite ® 16/30), |
| | 5.0 | g monoethanolamine |
| | 5.0 | g Aerosil R 972 (Degussa). |
| 5. | 600.0 | g calcined aluminosilicate (Molochite ® 16/30), |
| | 5.0 | g diethanolamine |
| | 2.5 | g Aerosil R 972 (Degussa). |
| 6. | 900.0 | g calcined aluminosilicate (Molochite ® 8/16) |
| | 7.5 | g monoethanolamine, |

-continued

| Sanding mixtures: |
|---|
| 3.75 g Aerosil R 972 (Degussa). |

The individual mixtures were prepared simply by mixing the components together.

In all of the examples, the model surface to be reproduced was first sprayed with a mixture of diethanolamine and water in a radio of 1:2; then the slip and sanding mixture were applied alternately. The slip was sprayed from a spray painting gun with a nozzle of 2 mm diameter, at a pressure of 1.5 to 2 atmospheres gauge.

The sanding material was applied at a pressure of less than 0.5 atosphere gauge from a "Putzmeister" gun.

EXAMPLE 1

Under the conditions described above, the first to fifth coating of spray slip A was applied alternately with sanding mixture 1 to a model, within about 5 minutes. The sixth coat of slip was backed in a known manner with a mixture of fireclay and water glass. After another 5 to 10 minutes the mold could be lifted off. It had a good green strength and could then be fired as usual. The finished mold was filled with molten steel GS 42 Cr Mo 4, and yielded a casting of high dimensional accuracy and a very smooth surface.

EXAMPLE 2

The procedure of Example 1 was followed, but the first to fifth coat was applied alternately with the sanding material 2. The mold obtained took slightly longer to dry than the mold obtained in Example 1, but otherwise it had the same properties.

EXAMPLE 3

The mold was made as described in Example 1. Spray slip A was used as the slip after it had been standing for 24 hours; sanding material 3 was used. The mold produced had the same properties as the mold of Example 1.

EXAMPLE 4

The procedure of Example 3 was repeated, except that sanding mixture 4 was used. The results are similar to those of Example 3.

EXAMPLE 5

The procedure of Example 3 was repeated except that sanding mixture 5 was used. The results are similar to those of Example 3.

EXAMPLE 6

A total of ten coats of a spray slip A were applied to the model after standing for 24 hours. The sanding of the first and second coat was performed with sanding mixture 1, the third, fourth and fifth coat with sanding mixture 4, and the sixth to tenth coat with sanding mixture 6. The preparation of the mold in the manner described required about 12 to 14 minutes. An aluminum-silicon alloy was cast in the mold, yielding a casting of high dimensional accuracy and a very smooth surface.

EXAMPLE 7

The procedure of Example 1 was repeated, with the difference that spray slip B and sanding material 5 were used. Molds were obtained having the same properties as in Example 1 were obtained.

EXAMPLE 8

The procedure of Example 1 was repeated, with the difference that spray slip C and sanding material 3 were used. A chrome-molybdenum steel cast in the mold had a very smooth surface and good dimensional accuracy.

It will be understood that the specification and examples are illustrative but not limitative of the present invention and that other embodiments within the spirit and scope of the invention will suggest themselves to those skilled in the art.

What is claimed is:

1. A method of making a mold for casting metal, comprising:

(a) providing a permanent model of the mold;

(b) spraying a layer of an anhydrous fluid ceramic slip which cures without the addition of water onto the surface of the model, the fluid ceramic slip comprising granular refractory substances, a binding agent of a partially-condensed and partially-hydrolized alkyl silicate containing hydroxyl groups and between 18 and 25%, by weight, $SiO_2$, and no hardener;

(c) thereafter sanding the slip layer by throwing a sanding material thereinto, the sanding material comprising a granular refractory substance having a grain size between 0.07 and 0.25 mm and a hardener, the hardener comprising means comprisng at least one amine for hardening the slip by chemical action;

(d) allowing the hardener to so harden the slip; and (e) removing the hardened slip from the model for use as the mold.

2. A method of hardening a layer of an anhydrous fluid ceramic slip which cures without addition of water, said ceramic slip being of granular refractory substances, a binding agent of a partiallycondensed and partially-hydrolized alkyl silicate containing hydroxyl groups and between 18 and 25%, by weight, $SiO_2$, and no hardener on a permanent model for a mold comprising:

(a) thereafter sanding the slip layer with a sanding material, the sanding material comprising a granular refractory substance having a grain size between 0.07 and 0.25 mm and a hardener, the hardener comprising means comprising at least one amine for hardening the slip by chemical action; and (b) allowing the hardener to so harden the slip, whereby the slip may be stored and applied as a layer without hardening until sanded with the sanding material.

3. The method of claim 1 wherein the sanding material further comprises a finely granular, highly absorbent material such as silica for preserving the free-flowing quality of the sanding material.

4. The method of claim 2 wherein the hardener is selected from one or more of the group consisting of primary, secondary and tertiary amines; and salts and hydroxides of alkali and alkaline earth metals and ammonia.

5. The method of claim 2 wherein the amine is a liquid at room temperature and comprises up to about 2% by weight of the sanding material.

6. The method of claim 2 wherein the sanding material further method of claim 2 wherein the sanding material further comprises a finely granular, highly absorbent material such as silica for preversing the free-flowing quality of the sanding material.

7. The method of claim 1, wherein the slip layer is sanded by the spin-on deposition method.

8. The method of claim 2, wherein the slip layer is sanded by the spin-on deposition method.

9. The method of claim 1 wherein the amine is a liquid at room temperature and comprises up to about 25% by weight of the sanding material.

10. The method of claim 1 wherein the hardener is selected from one or more of the group consisting of primary, secndary and tertiary amines; and salts and hydroxids of alkali and alkaline earth metals and ammonia.

* * * * *

UNITED STATES PATENT AND TRADEMARK OFFICE

CERTIFICATE OF CORRECTION

PATENT NO. : 4,715,895

DATED : December 29, 1987

INVENTOR(S) : Friedhelm Schnippering, et al.

It is certified that error appears in the above-identified patent and that said Letters Patent is hereby corrected as shown below:

Title page, item [63], line 1, "Sep. 15, 1984" should read --Aug. 22, 1985--.

Column 1, line 63, "relativly" should read --relatively--.

Column 2, line 1, "itself tools" should read --itself with tools--.

Column 2, line 43, "whcih" should read --which--.

Column 3, line 26, "anti-setting" should read -anti-settling--.

Column 5, line 17, "atosphere" should read --atmosphere--.

Column 6, line 68 to Column 7, line 1, delete "method of claim 2 wherein the sanding material further".

Column 8, line 1, "25%" should read --2%--.

Signed and Sealed this

Thirtieth Day of October, 1990

*Attest:*

HARRY F. MANBECK, JR.

*Attesting Officer*

*Commissioner of Patents and Trademarks*